United States Patent [19]

Trammell et al.

[11] 4,250,987

[45] Feb. 17, 1981

[54] FLOW CONTROL GATE APPARATUS

[75] Inventors: Edward L. Trammell; Hugh D. Kelley, both of Wichita, Kans.

[73] Assignee: Tramco Metal Products, Inc., Wichita, Kans.

[21] Appl. No.: 965,232

[22] Filed: Dec. 1, 1978

[51] Int. Cl.[3] ..... B65G 47/19

[52] U.S. Cl. ..... 198/530; 198/561; 222/310; 251/250

[58] Field of Search ..... 198/530, 532, 561, 735, 198/860, 861; 406/130; 222/310; 251/250

[56] References Cited

U.S. PATENT DOCUMENTS

| | | | |
|---|---|---|---|
| 713,622 | 11/1902 | Enyart | 251/250 |
| 2,007,874 | 7/1935 | Redler | 198/363 |
| 2,428,774 | 10/1947 | Bergmann et al. | 198/532 |
| 3,446,538 | 5/1969 | Danielson | 406/130 |
| 3,693,846 | 9/1972 | Schuller | 251/250 X |

FOREIGN PATENT DOCUMENTS

| | | | |
|---|---|---|---|
| 1023407 | 1/1958 | Fed. Rep. of Germany | 198/530 |
| 1481058 | 1/1969 | Fed. Rep. of Germany | 198/532 |
| 441122 | 1/1968 | Switzerland | 198/530 |

*Primary Examiner*—Jeffrey V. Nase
*Attorney, Agent, or Firm*—Phillip A. Rein

[57] ABSTRACT

This invention is a flow control gate apparatus mounted between a discharge opening of a hopper assembly and between a portion of a conveyor assembly operable to control amount of grain or the like being discharged into the interior of the conveyor means. The conveyor assembly includes a conveyor housing having a conveyor chain assembly mounted therein with spaced flight members to move the material laterally. The slide gate assembly is movable to opened and closed positions and control size of the discharge through the conveyor assembly having a horizontally movable slide gate member actuated by a control handle assembly. The control handle assembly includes a rack member secured to the slide gate member, a handle member mounted on a support shaft, and a pinion gear mounted on the support shaft engagable with the rack member to longitudinally move the slide gate member. The slide gate assembly is very compact requiring little vertical height so it can be easily installed in existing conveyor assembly system.

4 Claims, 4 Drawing Figures

FLOW CONTROL GATE APPARATUS

PRIOR ART

A search of the prior art revealed the following patent references U.S. Pat. Nos.: 1,305,880; 2,007,874; 2,633,230; 1,760,848; 2,342,039; 3,620,350.

The Cheek patent discloses a slidable gate used with a conveyor structure but does not control material movement from a hopper. The Davis patent teaches a gate to control discharge from a conveyor belt-bucket member.

However, none of the patents teach our specific combination of elements usable in existing grain elevators to control grain flow utilizing a minimum amount of vertical height.

PREFERRED EMBODIMENT OF THE INVENTION

In one preferred embodiment of the invention, a flow control gate apparatus includes a material type conveyor means, a hopper means mounted on the conveyor means to supply the material thereto, and a slide gate means mounted between a portion of the conveyor means and the hopper means to control the amount of material flow therebetween. The conveyor means is of a substantially conventional type including a conveyor housing with a conveyor chain assembly mounted therein. The conveyor chain assembly includes an endless conveyor chain member with spaced flight members connected thereto. The flight members cooperate with the conveyor housing to move the material, such as grain, longitudinally to another discharge point on the conveyor chain assembly. The hopper means acts to direct the material downwardly through a discharge opening to the conveyor means. The hopper means includes an on-off control valve with the slide gate means of this invention then controlling the amount of material flow. The slide gate means includes a horizontally movable slide gate assembly connected to a control handle assembly. The slide gate assembly includes a slide gate member selectively movable toward opened and closed positions to control the amount of material flow from the discharge opening from the hopper means. The control handle assembly includes (1) a handle member secured to one end of a support shaft; (2) a rack member connected to an undersurface of the slide gate member; and (3) a pinion gear member mounted on the support shaft and engagable with the rack member. The handle member is rotatable to rotate the pinion gear member and engage the rack member to move the interconnected slide gate member to open and close (in amount desired and regulate the amount of material flow from ) the discharge opening from the hopper means. This horizontal movement is a fine control of material discharge into the conveyor means and takes a minimum amount of vertical height.

OBJECTS OF THE INVENTION

One object of this invention is to provide a flow control gate apparatus that requires a minimum amount of vertical height and, therefore, is readily connected to existing conveyor structures.

Another object of this invention is to provide a flow control gate appatatus mounted between a hopper means and a portion of a conveyor means to accurately control material flow therebetween.

Still, another object of this invention is to provide a horizontally movable slide gate means to precisely control material flow between a hopper means and into a conveyor means.

One further object of this invention is to provide a slide gate means having a horiziontally movable slide gate member actuated by a rack member and pinion gear member combination.

One other object of this invention is to provide a slide gate means that is reliable in operation, sturdy in construction, and easy to use.

Various other objects, advantages, and features of the invention will become apparent to those skilled in the art from the following discussion, taken in conjunction with the accompanying drawings, in which:

FIGURES OF THE INVENTION

Figure 1:
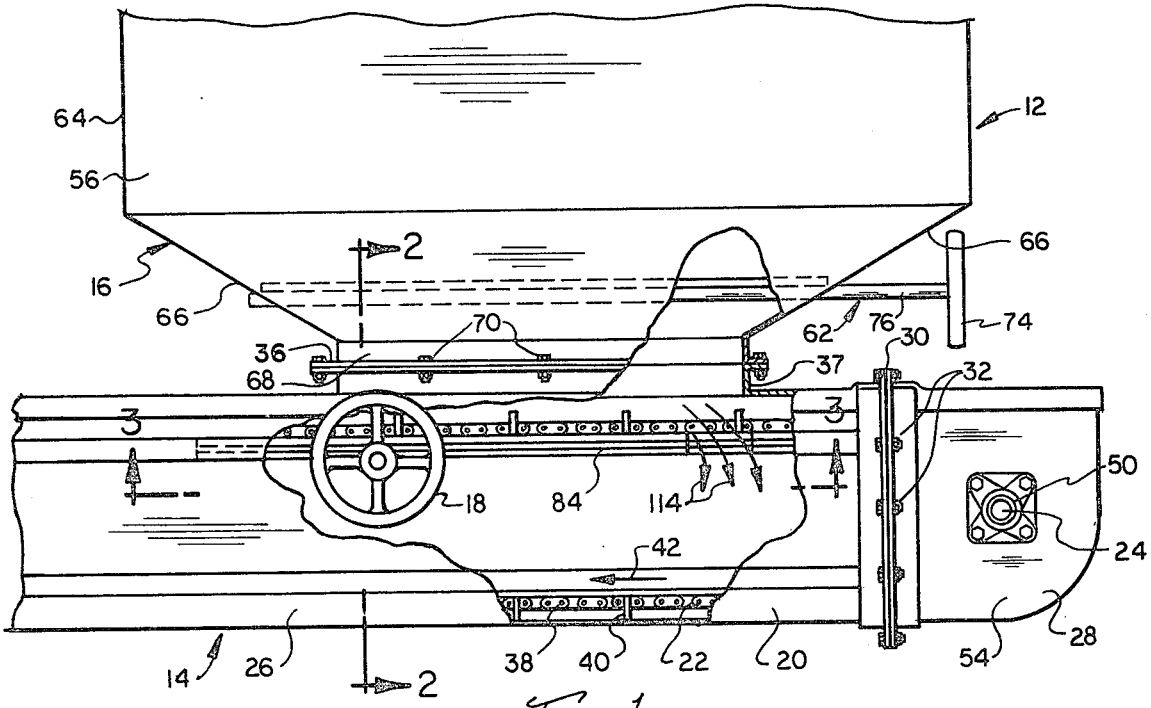
FIG. 1 is a side elevational view of the flow control gate apparatus of this invention having portions broken away for clarity.

The following is a discussion and description of preferred specific embodiments of the new flow control gate apparatus of this invention, such being made with reference to the drawings, whereupon the same reference numerals are used to indicate the same or similar parts and/or structure. It is to be understood that such discussion and description is not to unduly limit the scope of the invention.

SPECIFICATION OF THE INVENTION

Referring to the drawings in detail and, in particular to FIG. 1, a flow control gate apparatus, indicated generally at 12, includes (1) a conveyor means or assembly 14 operable to move material such as grain longitudinally from one location to another; (2) a hopper means or assembly 16 is mounted on the conveyor means 14 to discharge the material into the conveyor means 14; and (3) a slide gate means or assembly 18 is mounted between a connection of the hopper means 16 within the conveyor means 14 to accurately control material discharge thereto.

The conveyor means 14 includes (1) a conveyor housing 20; (2) a conveyor chain assembly 22 mounted within the conveyor housing 20; and (3) an idler wheel assembly 24 connected to one end of the conveyor housing 20 and operably connected to the conveyor chain assembly 22.

The conveyor housing 20 includes a main housing section 26 connected to a tail housing section 28 through a connector flange 30. The main housing section 26 is substantially as described in a pending patent application entitled MEANS FOR ALIGNING AND SECURING ADJACENT CONVEYOR TROUGH STRUCTURES, filed Sept. 18, 1978, Ser. No. 942,924, having the same inventors as herein. Various sections of the main housing section 26 can be interconnected by nut and bolt members 32 at the connector flanges 30 to achieve a desired conveyor length.

The main housing section 26 includes a discharge opening 34 into the hopper means 16 having a connector flange member 36 about the periphery of the discharge opening 34. The discharge opening 34 is of rectangular shape having a width equal to that of the main housing section 26 and defined by vertical walls 37.

The tail housing section 28 is bolted to an outer one of the main housing sections 26 and presents an end wherein the conveyor chain passes over a sprocket and reverses direction in a manner to be explained.

The conveyor chain assembly 22 includes an endless conveyor chain member 38 having a plurality of spaced flight members 40 connected thereto. The flight members 40 extend transversely of the longitudinal axis of the main housing section 26 to move material therein as indicated by an arrow 42 (FIG. 1). Inner sidewalls 44 of the main housing section 26 are formed with opposed pairs of indentations 46 to receive and align the flight members 40 thereon.

The idler wheel assembly 24 includes a driven idler shaft member 48 having outer ends supported in spaced bearing members 50 and a mid-portion supports a driven sprocket gear member 52 thereon. The aligned bearing members 50 are bolted to outer sidewalls 54 of the tail housing section 28 as best shown in FIG. 1.

The sprocket gear member 52 is operable to receive the endless conveyor chain member 38 thereon to provide movement of the flight members 40 in the proper planes. At the other end of the conveyor housing 20 will be found a drive sprocket gear member (not shown) to provide a drive force to the endless conveyor chain member 38.

Figure 2:
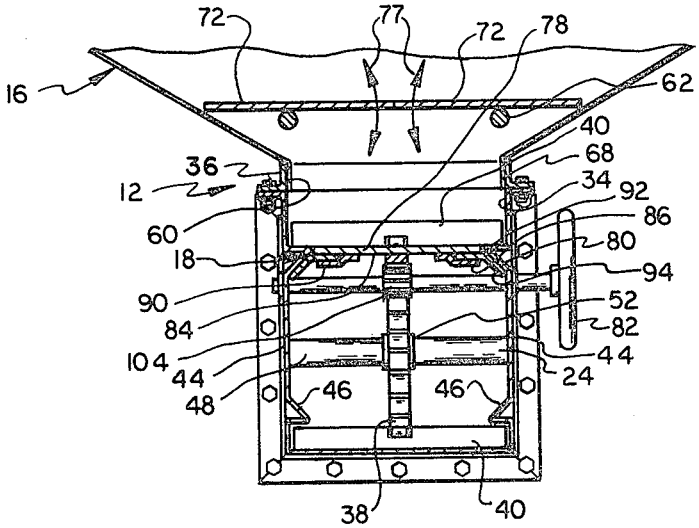
FIG. 2 is a fragmentary sectional view taken along line 2—2 in FIG. 1.

As shown in FIGS. 1 and 2, the hopper means 16 includes (1) a hopper assembly 56; (2) the connector flange 36 mounted about the periphery of a discharge opening 60 from the hopper assembly 56; and (3) a flow control valve 62 mounted in the hopper assembly 56 which acts as a fully opened or closed valve to the discharge opening 60.

The hopper assembly 56 is of a conventional nature having upright sidewalls 64 integral with inclined bottom walls 66. The discharge opening 60 is defined by vertical walls 68 which are connected to the connector flange 36.

As noted in FIG. 1, the connector flange 36 is anchored by a plurality of nut and bolt members 70 to the vertical walls 37 of the main housing sections 26. In this condition, the discharge opening 34 of the main housing section 26 and the discharge opening 60 from the hopper assembly 56 are aligned.

The flow control valve 62 is of a conventional nature which can be constructed of flip valve sections 72 controlled by a rotatable valve handle 74 mounted on an actuator shaft 76. The flip valve sections 72 are moved to one of two positions, for example, either fully opened or fully closed as shown by arrows 77. This controls material flow through the aligned discharge openings 34, 60 to the slide gate means 18. In turn, the slide gate means 18 is movable horizontally to accurately control the amount of material flow to the interior of the conveyor means 14.

The slide gate means 18 includes a slide gate assembly 78 mounted on a connector plate assembly 80 and actuated through a control handle assembly 82. The slide gate assembly 78 includes a slide gate member 84 of rectangular plate construction having a spaced, pair of alignment members 86 secured to an undersurface thereof. The slide gate member 84 is of a size larger than the discharge openings 34, 60 to control material flow to the interior of the conveyor means 14.

The alignment members 86 extend the length of the slide gate member 84 for engagement with the connector plate assembly 80. Each alignment member 86 includes an anchor section 88 integral with a stepped section 90. The anchor section 88 is secured as by welding to the slide gate member 84 (See FIG. 2).

The connector plate assembly 80 includes a pair of spaced track members 92 secured to respective opposed inclined walls 94 of the indentations 46 of the main housing section 26. Each track member 92 is of generally flattened V-shape having a top leg portion 96 adapted to support the slide gate member 84 thereon. It is obvious that the track members 92 remain stationary and support the slide gate member 84 which moves horizontally and longitudinally thereon.

As shown in FIG. 1, an end wall of the slide gate member 84 adjacent a plurality of arrows 114 (indicating material flow) is movable to the right in FIG. 1 to a closed position against a stop end wall which is vertically aligned with the outer vertical wall 37 which is in a common vertical plane therewith. Similarly, the slide gate member 84, as shown in FIG. 1, is movable to the left to place the subject end wall of the slide gate member 84 in vertical alignment with the opposed outer vertical wall 37 to achieve the fully opened position for maximum material flow to the interior of the conveyor means 14.

The control handle assembly 82 includes a (1) handle member 98 secured to one end of a main control shaft 101; (2) bearing members 103 in the sidewalls 44 of the main housing seciton 26 to support the opposed end portions of the main control shaft 101 therein; (3) a pinion gear member 104 secured to the mid-section of the main control shaft 101; and (4) a rail member 106 secured to an undersurface of the slide gate member 84 and engagable with the pinion gear member 104.

The handle member 98 is of a conventional type resembling a wheel member being rotatable to, in turn, rotate the main control shaft 101 to actuate the rack member 106 and the pinion gear member 104 in a manner to be explained.

Figure 3:
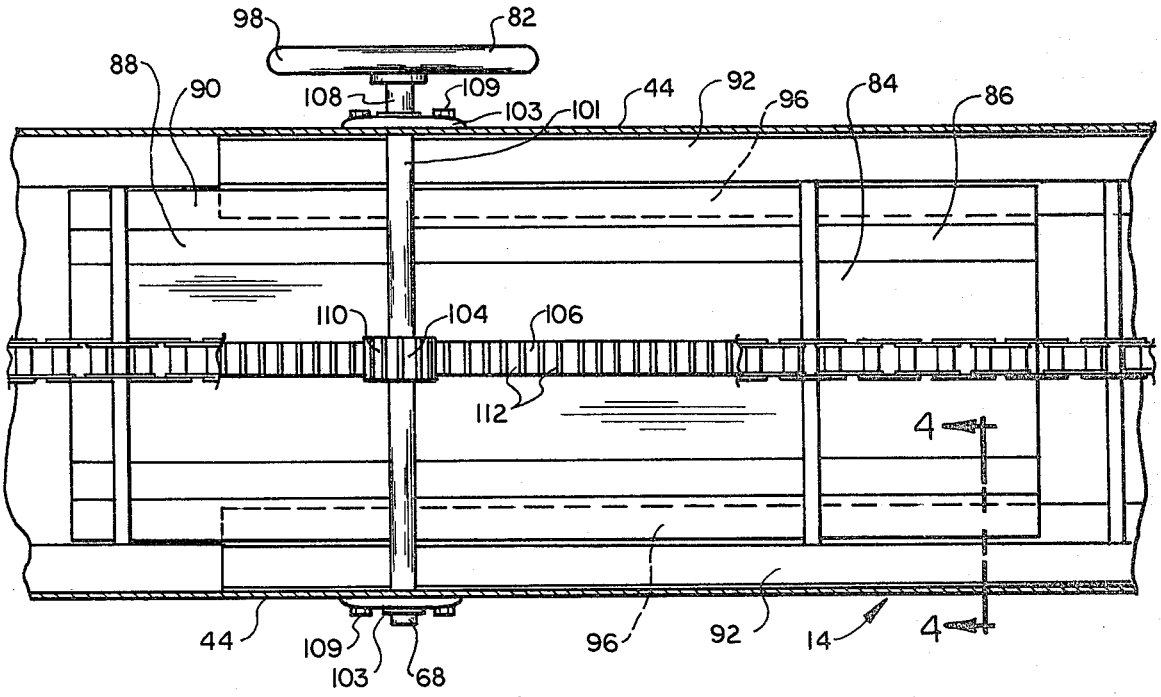
FIG. 3 is an enlarged sectional view taken along line 3—3 in FIG. 1.
Figure 4:
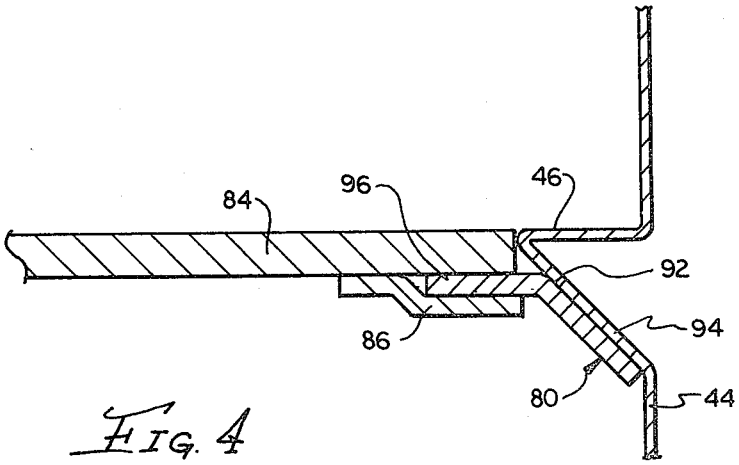
FIG. 4 is an enlarged fragmentary sectional view taken along line 4—4 in FIG. 3.

As noted in FIG. 3, the opposite end portions 108 of the main control shaft 101 are rotatably mounted in the bearing members 103 which, in turn, are secured as by bolt members 109 to the opposed sidewalls 44 of the main housing sections 26.

The pinion gear member 104 is anchored to the main control shaft 101 as by a lock key or welding so as to rotate therewith. The pinion gear member 104 is formed with teeth members 110 about its outer periphery.

As shown in FIG. 3, the rack member 106 extends longitudinally of the slide gate member 84 and includes a plurality of rack teeth members 112. It is obvious that the rack teeth members 112 are engagable with the teeth members 110 on the pinion gear member 104 to move the slide gate member 84 horizontally as will be described.

USE AND OPERATION OF THE INVENTION

In the use and operation of the flow control gate apparatus 12 of this invention, the slide gate means 18 is installed below the discharge opening 60 of the hopper means 16 and the discharge opening 34 of the main housing section 26 of the conveyor means 14. The hopper means 16 and the conveyor means 14 may be of existing conventional types as the main novelty lies in the horizontally movable slide gate means 18 which is readily installed in existing systems. This is mainly possible because a minimum of vertical space is necessary for the slide gate means 18.

Material flow from the hopper means 16 to the conveyor means 14 and first controlled by the flow control valve 62 which is normally fully opened or closed.

The actual material flow from the hopper means 16 into the conveyor means 14 to the interior thereof is accurately regulated by the slide gate means 18. More specifically, the handle member 98 is rotatable to turn the main control shaft 101 and attached pinion gear member 104. As seen in FIG. 3, the pinion gear member 104 engages the rack member 106 secured to the slide gate member 84.

This, by rotating the handle member 98, the slide gate member 84 is moved horizontally to a desired, regulated, open position. This controls the amount of material such as grain moving downwardly as shown by the arrows 114 in FIG. 1. The material is then moved horizontally as shown by the arrow 42 to a desired destination by the conveyor means 14. The slide gate member 84 may be moved to a fully opened position if desired but normally regulated between fully opened and fully closed depending on the material and capacity of the conveyor means 14.

The slide gate means of this invention is sturdy in construction, easy to install on existing conveyor systems, and reliable in operation. The slide gate means uses a minimum of vertical heights which permits use thereof in the existing conveyor systems.

While the invention has been described in conjunction with preferred specific embodiments thereof, it will be understood that this description is intended to illustrate and not to limit the scope of the invention, which is defined by the following claims.

I claim:

1. A flow control gate apparatus operable to regulate and control material flow, comprising:

(a) a conveyor means operable to receive the material and move same longitudinally;

(b) a hopper means mounted on said conveyor means to hold material therein for selective discharge into said conveyor means through a flow control valve and a discharge opening;

(c) a slide gate means includes a slide gate assembly having a slide gate member of a size greater than said discharge opening on said hopper means mounted between a portion of said conveyor means and said hopper means to control amount of material flow to the interior of said conveyor means;

(d) said slide gate assembly selectively movable horizontally by a control handle assembly to permit regulated material flow from said hopper means to said interior of said conveyor means;

(e) said slide gate member positioned below said discharge opening in said hopper means and movable from fully opened to closed positions and operable in the fully opened position to allow maximum flow of material through said discharge opening in said hopper means;

(f) said slide gate member mounted for horizontal, longitudinal movement in a connector plate assembly;

(g) said connector plate assembly mounted about said discharge opening;

(h) said control handle assembly engageable with said slide gate member to move same horizontally for material flow through said discharge opening in said hopper means;

(i) said control handle assembly includes a handle member mounted on a main control shaft having opposite end portions rotatably mounted in bearing members; and (j) said control handle assembly includes a pinion gear member mounted on said main control shaft and a rack member secured to the center and undersurface of said slide gate member to prevent clogging thereof by the material flow.

2. A flow control gate apparatus as described in claim 1, wherein:

said pinion gear member is engagable with said rack member to move said slide gate member horizontally and longitudinally.

3. A flow control gate apparatus as described in claim 1, wherein:

(a) said connector plate assembly secured to said conveyor means and operable to support said slide gate assembly thereon for longitudinal movement;

(b) said connector plate assembly includes a pair of spaced track members mounted adjacent a discharge opening into said interior of said conveyor means;

(c) said slide gate member having a pair of spaced, alignment members secured to an undersurface thereof;

(d) said alignment members engagable with said track members to guide said slide gate members during horizontal movement thereof;

(e) said conveyor means having a conveyor chain member, a plurality of flight members connected to said conveyor chain member, and a conveyor housing to receive said conveyor chain member;

(f) said conveyor chain member moves around said slide gate member; and (g) said conveyor housing having inward indentations to receive and support the upper ones of said flight members thereon adjacent said slide gate member.

4. A flow gate apparatus as described in claim 1, wherein:

(a) said connector plate assembly anchored to said conveyor means about said discharge opening therein;

(b) said hopper means having said discharge opening aligned with a discharge opening in said conveyor means;

(c) said control handle assembly engagable with said slide gate member to selectively move same longitudinally to permit material to flow through said discharge opening of the hopper means unto said interior of said conveyor means for subsequent lateral movement; and (d) said pinion gear member is engagable with said rack member to move said slide gate member horizontally and longitudinally.

* * * * *